US008893449B1

(12) United States Patent
Underkofler et al.

(10) Patent No.: US 8,893,449 B1
(45) Date of Patent: Nov. 25, 2014

(54) GRID RUNNER SUPPORT BRACE

(71) Applicant: USG Interiors, LLC, Chicago, IL (US)

(72) Inventors: Abraham M. Underkofler, Waukegan, IL (US); Peder J. Gulbrandsen, Aurora, IL (US); Mark R. Paulsen, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 14/023,484

(22) Filed: Sep. 11, 2013

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04B 9/18*** | (2006.01) |

(52) U.S. Cl.
CPC ..... *E04B 9/18* (2013.01)
USPC ..... 52/506.08; 52/506.06; 52/506.07; 52/657; 52/509; 52/511

(58) Field of Classification Search
USPC ..... 52/506.06, 506.07, 506.08, 657, 509, 52/511
See application file for complete search history.

(56) References Cited

U.S. PATENT DOCUMENTS

| | | | | |
|---|---|---|---|---|
| 7,770,349 | B2 * | 8/2010 | Tedesco et al. | 52/506.08 |
| 2008/0060306 | A1 * | 3/2008 | Platt et al. | 52/506.06 |
| 2011/0283634 | A1 * | 11/2011 | Underkofler et al. | 52/167.1 |

* cited by examiner

*Primary Examiner* — Mark Wendell
(74) *Attorney, Agent, or Firm* — Pearne & Gordon LLP

(57) ABSTRACT

A suspended ceiling grid assembly including parallel spaced main runners and pairs of cross runners on opposite sides of a main runner, the main runners having vertical slots spaced along their lengths, the cross runners having end connectors mutually inter-engaged in a common main runner slot, a brace stabilizing the pair of cross runners against relative hinge action in a vertical plane, the brace being a thin metal body having a cross section complimentary to a cross section of the cross runners, the brace abutting sides of the cross runners and being rigidly attached thereto.

10 Claims, 2 Drawing Sheets

GRID RUNNER SUPPORT BRACE

BACKGROUND OF THE INVENTION

The invention relates to suspended ceiling construction and, in particular, to a grid runner accessory for supplementing the beam strength of a grid runner joint.

PRIOR ART

Island-type suspended ceilings use standard ceiling grid elements trimmed at the perimeter of the island with extruded or formed sheet metal vertically oriented moldings. It is desirable to locate overhead suspension wires inward from the perimeter so that they cannot be seen or are less conspicuous to an observer standing on the floor below. Set back of the suspension wires presents a problem where the grid runners have end joints that lie between the perimeter trim and the closest suspension wires. In these circumstances, a grid runner, bearing the weight of a portion of a tile or panel and part of the weight of the perimeter trim has a tendency to sag. It is also possible for this outlying weight to cause a grid runner or runners to pivot downwardly about the point where the suspension wire or wires are attached. This displacement at the ceiling perimeter can cause an inward section of the ceiling to rise above its intended plane. The foregoing explains a need for a practical solution for maintaining a suspension ceiling grid in its intended plane where the grid elements are cantilevered from their suspension wires.

SUMMARY OF THE INVENTION

The invention provides a brace for imparting beam strength to a joint between grid runner ends. The brace can eliminate objectionable sag of cantilevered grid runners and lift-up of inboard grid runners associated with cantilevered runners.

The disclosed brace is preferably made of sheet metal and is configured to closely abut the concealed part of a standard grid runner profile. The configuration of the brace makes the brace self-aligning to the grid runners to which it is attached. Additionally, the brace is configured to avoid interference with the grid runner end connectors forming a joint that the brace bridges across and strengthens. Still further, the brace maintains a narrow cross-sectional profile along its full length so that no significant interference with the installation or removal of a ceiling panel occurs.

DESCRIPTION OF THE PREFERRED EMBODIMENT

Figure 3:
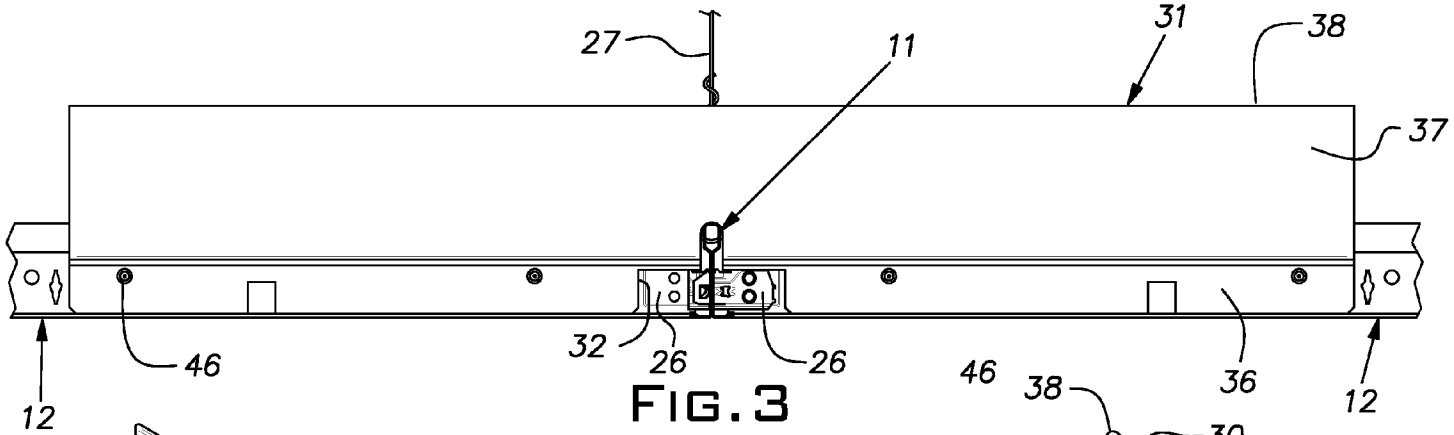
FIG. 3 is a side view of the brace of the invention on a pair of end joined cross runners.
Figure 2:
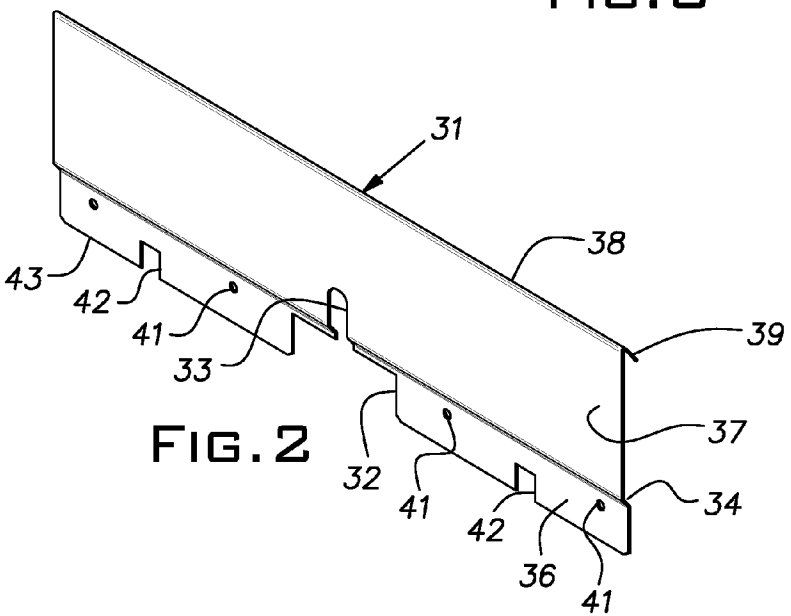
FIG. 2 is an isometric view of the brace of the invention.
Figure 4:
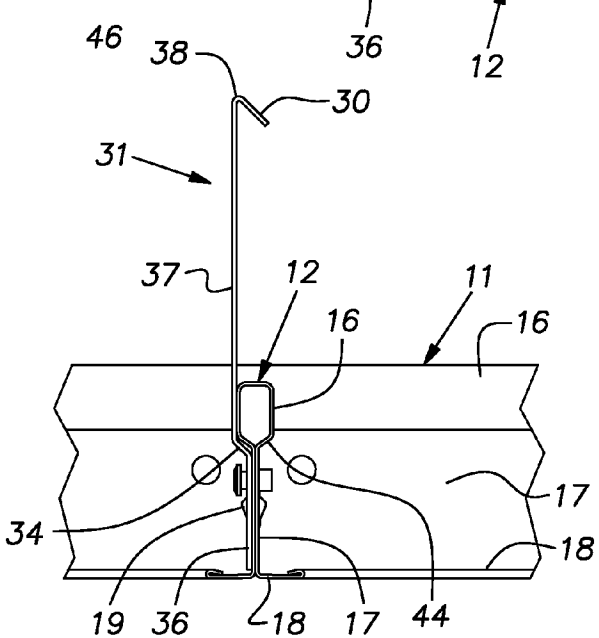
FIG. 4 is an end view of the brace of the invention and a cross-section through a typical grid cross runner.

A grid system 10 for an island ceiling comprises main runners 11 and cross runners 12. In the illustrated case, the runners 11, 12 have conventional inverted tee cross-sectional shapes. The grid runners 11, 12, as shown in FIGS. 3 and 4, are, as is conventional, roll-formed sheet metal parts having an upper hollow reinforcing bulb 16, a vertical central web 17, and a lower flange 18 extending laterally to both sides of the web. The main runners 11, as is customary, have vertical slots 19 in their webs 17 uniformly spaced along their lengths. The main runners 11 are connected directly end-to-end by end connectors such as disclosed in U.S. Pat. No. 7,703,258. The cross runners 12 are disposed on opposite sides of the main runners 11 and have end connectors joined through a common slot 19. An example of a suitable end connector is disclosed in U.S. Pat. Nos. 5,517,796 and 5,761,868.

The suspended island ceiling grid 10 includes a perimeter trim 21 that conceals the ends of the grid runners 11, 12 and the edges of ceiling tiles or panels (not shown) carried on the grid. The trim 21, which is at least several inches high, can be made of lengths 22 of aluminum or roll formed sheet metal. The trim lengths 22 are mounted on the grid runners 11, 12 with brackets 23 that are concealed when the trim lengths are installed.

Standard end connectors on the grid runners 11, 12 are primarily designed to provide high tensile resistance so that they do not readily pull apart. The end connectors, however, do not afford high bending moment resistance in a vertical plane. Consequently, where a grid runner 11, 12 is in a cantilever arrangement so that it has an end that is not supported by an overhead wire, another grid runner, or another element it can sag below the ceiling plane. This tendency to sag is greater when the weight of perimeter trim 21 and that of ceiling tiles is added onto the weight of the unsupported grid runner.

It is desirable that suspension wires 27 supporting the island ceiling grid system 10 are spaced inwardly away from the perimeter so that they are not readily seen by a person standing below the ceiling. Consequently, in these circumstances, cross runners 12 intersecting the perimeter of the system 10 are typically not supported directly by a wire 27. Additionally, a perimeter trim length 22 may not be capable of supporting its weight as well as the weight of intersecting cross runners 12 and panels mounted on them. The cross runners at the perimeter are, therefore, typically, in a cantilevered condition. A cantilevered grid runner, in accordance with the invention, can be supported by a brace 31 that bridges a joint with an associated grid runner to impart additional beam strength to the cantilevered grid runner.

The brace 31 is an elongated metal strip having a cross-section complimentary to the external cross-section of a grid runner 11, 12 above its flange 18. In the illustrated case, the brace 31 is a sheet metal element with its cross-section shape and with its side profile formed in a stamping die or dies. The cross-section of the brace 31 is illustrated in FIG. 4 and its side profile is illustrated in FIG. 3. By way of example, the brace 31 can be stamped of hot-dipped galvanized steel of 0.03 inch thickness.

With reference to FIG. 3, it will be seen that the brace 31 is an elongated body symmetrical about the center of its length. At the center of its length, the brace 31 has a generally rectangular cut out 32 with a central upwardly extending notch 33. On a lower half, and preferably on a lower ⅓ of its height, the wall of the brace 31 has a step 34, with a horizontal component, extending the full length of the brace. From the step 34, the brace has a lower wall portion 36 that extends vertically downwardly, and an upper wall portion 37 that extends vertically upwardly. At an upper edge 38, the upper wall portion 37 has an integral flange 39 bent obtusely so that it is inclined downwardly from its attachment with the wall proper. Preferably, the height of the brace 31 exceeds twice the height of the grid runners with which it is used. A pair of spaced holes 41 are provided on each half length of the brace 31. One of the holes 41 is adjacent the cut out 32 and the other hole 41 is adjacent an end of the brace 31. Notches 42 in the lower wall portion 36 from a lower edge 43 are spaced from the central cut out 32.

FIGS. 3 and 4 illustrate the brace 31 installed on two end connected cross runners 12 on opposite sides of a main runner 11. The lower wall portion 36 of the brace 31 fits closely in the pocket between the cross runner flange 17 and the cross runner reinforcing bulb 16 in both the cantilevered cross runner 12 and the runner 12 to which the cantilevered runner is connected. The lower edge 43 of the lower wall portion 36 rests on top of the flange 18 and an upper edge of the lower wall portion at the offset or step 34 contacts a lower face 44 of the reinforcing bulb 16. Suitable fasteners such as self-drilling screws 46 are assembled through the holes 41 and are driven through the web 17 of the associated cross runner 12 to fix the brace 31 and cross runners 12 together. The vertical distance of the holes 41 above the lower edge 43 and adjacency to the step or offset 34 assures that the upper wall portion 37 will be drawn adjacent the reinforcing bulb 16 and the assembly of the brace 31 to the respective cross runner 12 will be rigid and stable.

As shown in FIG. 3, the cut out 32 is larger than the area occupied by the end connectors 26 so that regardless of the side of the cross runners 12 the brace 31 abuts interference with the connectors is avoided. FIG. 3 also reveals that the notch 33 at the mid-length of the brace 31 avoids interference with a main runner 11 which provides the slot in which the cross runner end connectors 26 are joined. When the brace 31 is installed, its flange 39 is situated over the cross runner reinforcing bulb 16 and, preferably, does not extend laterally beyond the bulb more than the thickness of the brace material so that it does not interfere with placement or removal of a ceiling panel.

The brace 31 transfers the bending moment on a cantilevered cross runner 12 to the associated cross runner to which the cantilevered cross runner is connected. The associated cross runner, in turn, transfers this moment to the interior of the grid system 10 where it can be sustained.

Figure 1:
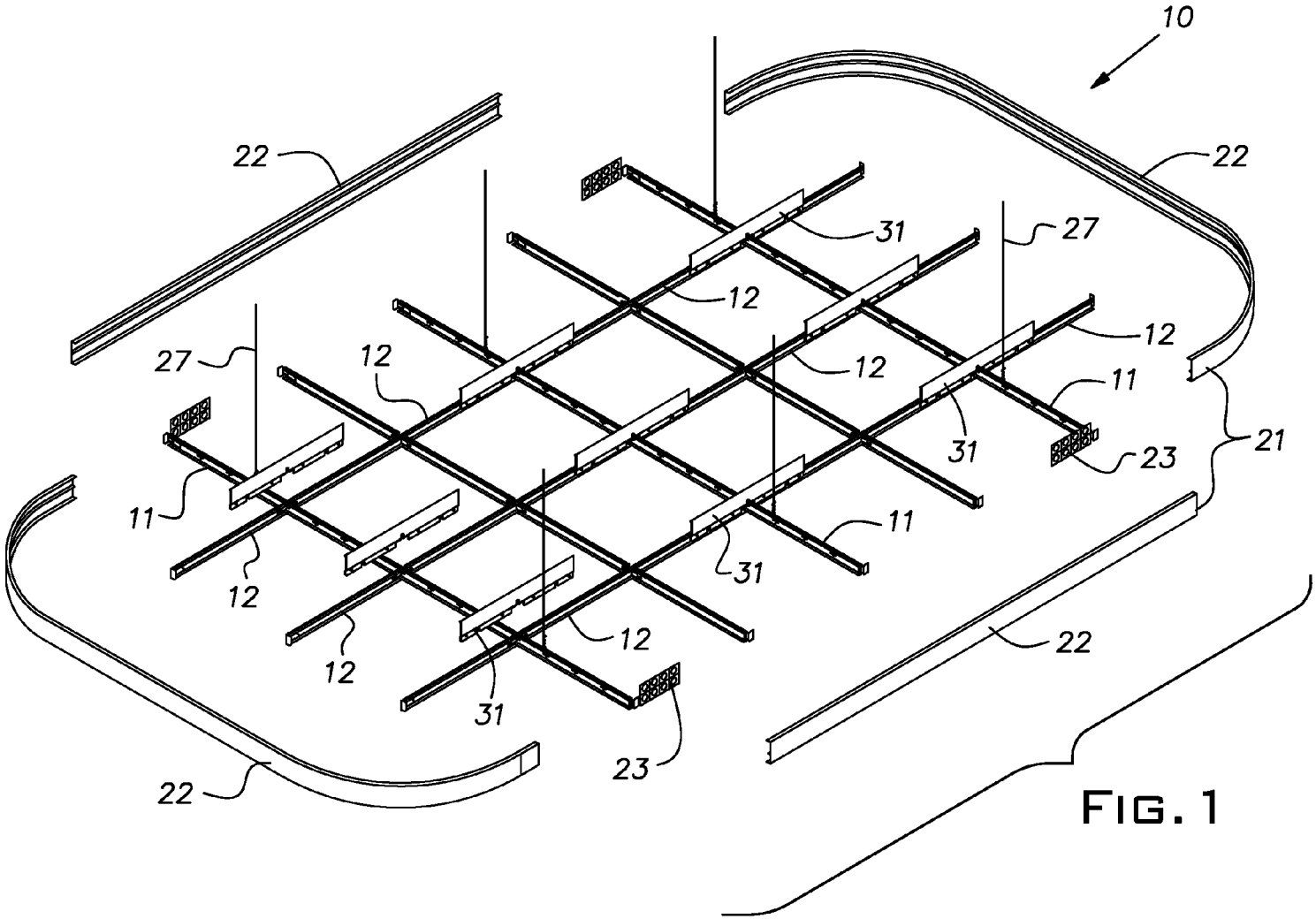
FIG. 1 is an isometric view looking down on a suspended grid, with perimeter trim exploded away, forming an island ceiling.

The weight of the perimeter trim 21 supported on cross runners using the point of attachment of a nearby suspension wire 27 as a fulcrum may tend to lift an inboard portion of the ceiling system 10 where the ceiling grid can "hinge" at a joint between grid runner ends. To eliminate this hinge action, the brace 31 can be attached to the involved cross runners 12 in the manner described above. This is illustrated by the middle row of braces 31 in FIG. 1.

The notches 42 in the lower wall portion 36 can accommodate tile centering projections (not shown) on the web of the host grid runner 12.

The disclosed brace 31 can be used in essentially the same manner as described above on main runners 11. On shorter cross runners 12, when the screws 46 are assembled in the holes 41, the lower wall portion 36 is trapped snuggly in the pocket between the cross runner flange 18 and cross runner bulb 16 of the respective cross runners making a rigid assembly of the connected pair of cross runners and brace 31.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling grid assembly including parallel spaced main runners and pairs of cross runners on opposite sides of the main runners, the main and cross runners each having an upper hollow reinforcing bulb, a web below the reinforcing bulb and a lower flange below the web, the main runner webs having vertical slots spaced along the length of a main runner, the cross runners having end connectors mutually inter-engaged in a common main runner slot, a brace stabilizing a pair of inter-engaged cross runners against relative hinge action in a vertical plane, the brace being a thin metal body having a cross section complimentary to a cross section of the cross runners formed by the reinforcing bulbs and webs, a lower wall portion of the brace abutting webs of the cross runners and being rigidly attached thereto, the lower wall portion of the brace closely fitting vertically between the reinforcing bulb and a lower flange of each of the pair of inter-engaged cross runners, the brace having a cut out at its mid-length to avoid interference with said end connectors and enable abutment of the brace lower wall portion to the cross runner webs adjacent the end connectors, the brace having a vertical height greater than two times a height of a cross runner over the cut out and over length portions of the associated pair of cross runners greater in dimension than the vertical height.

2. An assembly as set forth in claim 1, wherein said brace lower wall portion includes preformed holes on each of its half lengths disposed in a position to overlie a web of a cross runner adjacent a reinforcing bulb thereof.

3. An assembly as set forth in claim 1, wherein said brace is formed of sheet metal.

4. A suspended ceiling grid assembly including parallel spaced main runners and pairs of cross runners on opposite sides of a main runner, the main runners having vertical slots spaced along their lengths, the cross runners having end connectors mutually inter-engaged in a common main runner slot, a brace stabilizing the pair of cross runners against relative hinge action in a vertical plane, the brace being a thin metal body having a cross section complimentary to a cross section of the cross runners, the brace abutting sides of the cross runners and being rigidly attached thereto, the brace having a cut out at its mid-length to avoid interference with said end connectors, the brace having a vertical height greater than two times a height of a cross runner over the cut out and over length portions of the associated pair of cross runners greater in dimension than the vertical height, said brace including preformed holes on each of its half lengths disposed in a position to overlie a web of a cross runner adjacent a reinforcing bulb thereof, said brace including a notch contiguous with said cut out to avoid interference with a main runner through which said cross runner end connectors are assembled.

5. A suspended ceiling grid assembly including parallel spaced main runners and pairs of cross runners on opposite sides of a main runner, the main runners having vertical slots spaced along their lengths, the cross runners having end connectors mutually inter-engaged in a common main runner slot, a brace stabilizing the pair of cross runners against relative hinge action in a vertical plane, the brace being a thin metal body having a cross section complimentary to a cross section of the cross runners, the brace abutting sides of the cross runners and being rigidly attached thereto, said brace including an offset between a lower wall portion and an upper wall portion, said brace lower wall portion fitting closely in a zone between a lower flange of a cross runner and an upper reinforcing bulb of a cross runner such that a lower edge engages the flange of the cross runner and an upper edge of the lower wall portion at the offset engages an underside of the reinforcing bulb, the brace lower wall portion having a cutout at its mid-length to avoid interference with said end connectors and enable the brace lower wall portion to abut the side of the cross runners adjacent the cutout.

6. An assembly as set forth in claim 5, wherein said upper wall portion of said brace has a stiffening flange extending along its length.

7. An assembly as set forth in claim 6, wherein said stiffening flange overlies the reinforcing bulbs of the cross runners to which the brace is attached.

8. An assembly as set forth in claim 7, wherein the brace stiffening flange is limited in its horizontal extent to a width of the reinforcing bulb and a thickness of the material of the brace.

9. The assembly of claim 8, wherein the brace flange projects downwardly from an upper edge of the upper wall portion forming an obtuse angle with the upper wall portion.

10. A method of resisting a tendency of a cantilevered grid runner to sag at the periphery of a suspended island ceiling comprising providing an elongated metal brace having a vertical dimension of twice or more the height of the grid member and a lateral dimension limited to the width of the grid runner reinforcing bulb and the thickness of the brace, securing the brace to the sides of the cantilevered grid runner and a grid runner to which the cantilevered grid runner is connected at an inboard end with a lower wall portion of the brace closely fitting in a vertical space between an upper reinforcing bulb and a lower flange of each of the connected grid runners, whereby a moment imposed on the cantilevered grid member is transferred to the grid runner to which it is connected.

* * * * *